US009806404B2

(12) United States Patent
Chakam et al.

(10) Patent No.: US 9,806,404 B2
(45) Date of Patent: Oct. 31, 2017

(54) FIN-SHAPED MULTI-BAND ANTENNA MODULE

(71) Applicant: Continental Automotive GmbH, Hannover (DE)

(72) Inventors: Guy-Aymar Chakam, Regensburg (DE); Benjamin Becker, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 178 days.

(21) Appl. No.: 14/368,100

(22) PCT Filed: Dec. 18, 2012

(86) PCT No.: PCT/EP2012/075919

§ 371 (c)(1),
(2) Date: Jun. 23, 2014

(87) PCT Pub. No.: WO2013/092565

PCT Pub. Date: Jun. 27, 2013

(65) Prior Publication Data

US 2015/0061945 A1 Mar. 5, 2015

(30) Foreign Application Priority Data

Dec. 23, 2011 (DE) ..... 10 2011 089 805

(51) Int. Cl.
*H01Q 1/32* (2006.01)
*H01Q 9/36* (2006.01)
(Continued)

(52) U.S. Cl.
CPC ..... *H01Q 1/32* (2013.01); *H01Q 1/3275* (2013.01); *H01Q 1/36* (2013.01); *H01Q 5/307* (2015.01); *H01Q 5/378* (2015.01); *H01Q 9/36* (2013.01)

(58) Field of Classification Search
CPC ..... H01Q 5/307; H01Q 5/378; H01Q 1/32
(Continued)

(56) References Cited

U.S. PATENT DOCUMENTS 6,873,296 B2 * 3/2005 Langley ..... H01Q 1/283 343/705
6,909,400 B2 * 6/2005 Vothknecht ..... H01Q 9/0428 343/700 MS
(Continued)

FOREIGN PATENT DOCUMENTS

DE 10150149 A1 4/2003 ..... H01Q 5/00
DE 20320670 U1 2/2005 ..... H01Q 1/24
(Continued)

OTHER PUBLICATIONS

International Search Report and Written Opinion, Application No. PCT/EP2012/075919, 17 pages, dated Feb. 25, 2013.

*Primary Examiner* — Dameon E Levi
*Assistant Examiner* — Walter Davis
(74) *Attorney, Agent, or Firm* — Slayden Grubert Beard PLLC

(57) ABSTRACT

A fin-shaped multi-band antenna module, e.g., for vehicles, includes an antenna printed circuit board and a plate arranged thereupon. In a lower region the plate is mechanically connected to the antenna printed circuit board. A first monopole extends in an essentially vertical direction on the plate and is connected to the antenna printed circuit board in a lower region by a feed point. The first monopole is inductively extended in the vertical direction in an upper region of the first monopole in order to enable transmission and reception of electromagnetic waves in a lower telephone frequency range.

18 Claims, 4 Drawing Sheets

(51) Int. Cl.
*H01Q 5/307* (2015.01)
*H01Q 5/378* (2015.01)
*H01Q 1/36* (2006.01)

(58) Field of Classification Search
USPC ..... 343/713, 700
See application file for complete search history.

(56) References Cited

U.S. PATENT DOCUMENTS

| | | | | |
|---|---|---|---|---|
| 7,034,758 | B2 * | 4/2006 | Haidacher | H01Q 1/3275 343/700 MS |
| 7,187,335 | B2 | 3/2007 | Vincent | 343/722 |
| 7,333,065 | B2 * | 2/2008 | Lindackers | H01Q 1/3275 343/713 |
| 8,081,126 | B2 * | 12/2011 | Ikeda | H01Q 1/1207 343/700 MS |
| 8,125,404 | B2 * | 2/2012 | Chen | H01Q 9/30 343/700 MS |
| 8,248,315 | B2 * | 8/2012 | Lindackers | H01Q 1/1207 343/705 |
| 8,319,693 | B2 * | 11/2012 | Chakam | H01Q 1/088 343/711 |
| 2002/0149527 | A1 | 10/2002 | Wen et al. | 343/727 |
| 2008/0284653 | A1 | 11/2008 | Rikuta et al. | 373/700 MS |
| 2009/0207084 | A1 | 8/2009 | Ikeda et al. | 343/713 |
| 2012/0274519 | A1 | 11/2012 | Chakam et al. | 343/702 |
| 2013/0027258 | A1 | 1/2013 | Chakam et al. | 343/727 |

FOREIGN PATENT DOCUMENTS

| | | | | |
|---|---|---|---|---|
| DE | 102007055323 | B4 | 6/2009 | H01Q 1/32 |
| DE | 102009051605 | A1 | 5/2011 | H01Q 1/12 |
| DE | 102010004470 | A1 | 7/2011 | H01Q 1/32 |
| DE | 102010004503 | A1 | 7/2011 | H01Q 1/28 |
| WO | 2009/065806 | A1 | 5/2009 | H01Q 1/32 |
| WO | 2011/085987 | A1 | 7/2011 | H01Q 1/28 |
| WO | 2011/086107 | A1 | 7/2011 | H01Q 19/00 |
| WO | 2013/092565 | A1 | 6/2013 | H01Q 1/32 |

* cited by examiner

FIN-SHAPED MULTI-BAND ANTENNA MODULE

CROSS-REFERENCE TO RELATED APPLICATIONS

This application is a U.S. National Stage Application of International Application No. PCT/EP2012/075919 filed Dec. 18, 2012, which designates the United States of America, and claims priority to DE Application No. 10 2011 089 805.0 filed Dec. 23, 2011, the contents of which are hereby incorporated by reference in their entirety.

TECHNICAL FIELD

The present invention relates to a fin-shaped multi-band antenna module and a vehicle which is equipped with such an antenna module.

BACKGROUND

With fin-shaped multi-band antenna modules for vehicles, the aim is to be able to offer as many services as possible with a single antenna module. The problem here is that the different radio applications transmit data in different frequency ranges. In car-to-car applications, the corresponding frequencies are, for example, 5.875 Gigahertz to 5.925 Gigahertz, in LTE (3GPP long term evolution, also referred to as 3.9 G, a mobile radio standard which is specified as the UMTS successor of the third Generation Partnership Project (3GPP)) in the frequency range between 792 Megahertz and 862 Megahertz and between 2.5 Gigahertz and 2.69 Gigahertz, in the case of telephone antennas and the frequency range from 824 Megahertz to 960 Megahertz and between 1.71 Gigahertz and 2.2 Gigahertz. The size of the fin-shaped multi-band antenna module must not or must barely be modified. Nevertheless, the required bandwidth, the shape of the directivity pattern and the antenna gain must be maintained.

DE 102007055323 discloses a fin-shaped multi-band antenna module for vehicles with two receive antenna modules separated from one another. The first receive antenna module has a dedicated feed point and the second receive module has two further feed points which are isolated from one another. The two radio antenna modules in each case also have their own feed point.

In DE 102009051605, a further fin-shaped multi-band antenna module is described which is highly integrated. Not only the transmit and receive antenna elements, but also electronic matching or amplifier circuits with a transceiver, tuner or receiver are located under a common fin-shaped outer covering.

SUMMARY

One embodiment provides a fin-shaped multi-band antenna module, in particular for vehicles, with an antenna printed circuit board and a plate disposed thereon, the two largest areas of which extend in each case in a vertical and in a horizontal direction, wherein, in the vertical direction, the plate has a lower area on a lower end and an upper area on an upper end, wherein the plate is mechanically connected in the lower area to the antenna printed circuit board, a first monopole in the shape of a first arm, wherein the first monopole extends essentially in the vertical direction on at least one of the two largest areas of the plate and is connected in the vertical direction in a lower area of the first monopole via a feed point to the antenna printed circuit board, wherein the first monopole is designed for a transmission and reception of electromagnetic waves in an upper telephony frequency range, in particular in a range from 1710 MHz to 2170 MHz, and an inductive extension of the first monopole disposed in the vertical direction in an upper area of the first monopole in order to enable a transmission and reception of electromagnetic waves in a lower telephony frequency range and a lower LTE frequency range, in particular in a range from 792 MHz to 960 MHz.

In a further embodiment, the inductive extension of the first monopole comprises a spiral.

In a further embodiment, the antenna module comprises an additional second monopole in the shape of a second arm, wherein the second monopole extends on at least one of the two largest areas of the plate essentially in the vertical direction and, in the vertical direction in a lower area of the second monopole, is connected via the feed point to the antenna printed circuit board, wherein the second monopole runs in the horizontal direction offset in relation to the first monopole and is designed in particular for a transmission and reception of electromagnetic waves in an upper LTE frequency range, in particular in a range from 2.5 GHz to 2.69 GHz.

In a further embodiment, the antenna module comprises a dipole running essentially in the vertical direction, which is disposed in the upper area of the plate in such a way that it is capacitively coupled with the first monopole and is electromagnetically excitable via the first monopole, wherein the dipole is designed in particular for a transmission and reception of electromagnetic waves in the range of car-to-car frequencies, in particular in the range from 5.875 GHz to 5.925 GHz.

In a further embodiment, the dipole is disposed on a first of the two largest areas of the plate and the second monopole is disposed on a second of the two largest areas of the plate.

In a further embodiment, the dipole and the second monopole are disposed on a first of the two largest areas of the plate or wherein the dipole and the second monopole are disposed on a second of the two largest areas of the plate.

In a further embodiment, the antenna module comprises a stub which is disposed in the vertical direction in a lower area of the first monopole in order to match an impedance of an antenna ensemble including the first and the second monopole and the dipole to an impedance of a transceiver unit using the antenna module.

In a further embodiment, the first monopole has a bend in the vertical direction in a central area.

In a further embodiment, the antenna module comprises a further extension of the first monopole which is disposed in the upper area of the plate.

In a further embodiment, the upper area of the plate has a larger extension than the lower area of the plate in the horizontal direction.

Another embodiment provides a vehicle with an antenna module as disclosed above.

In a further embodiment, the antenna module is disposed on the vehicle in such a way that the dipole and the second monopole are located in a direction of travel of the vehicle behind the first monopole.

BRIEF DESCRIPTION OF THE DRAWINGS

Example embodiments of the invention are explained below with reference to the drawings, in which.

DETAILED DESCRIPTION

Figure 1:
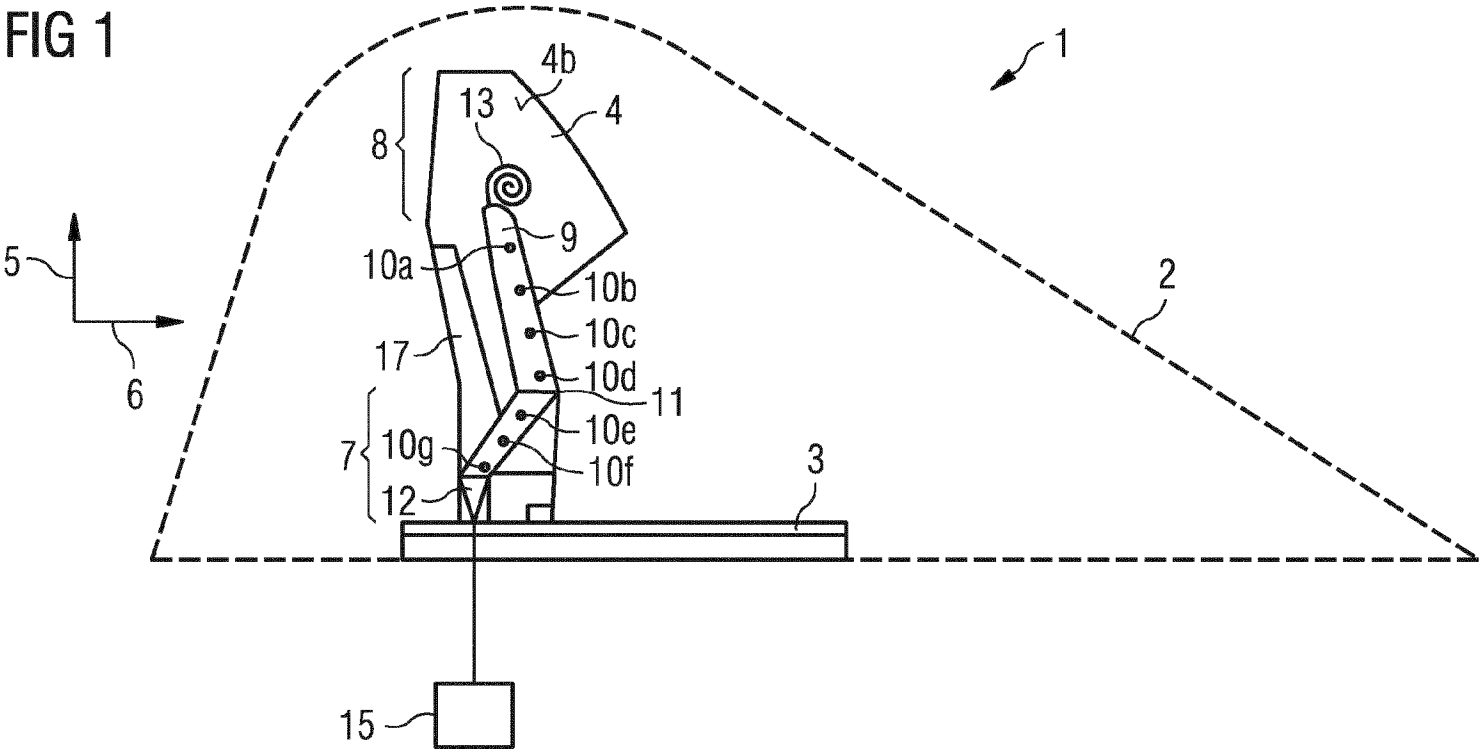
FIG. 1 shows an embodiment of a fin shaped multi-band antenna module according to the invention in a schematic representation from one side.

Embodiments of the present invention provide a fin-shaped, space-saving multi-band antenna module which supports a plurality of radio applications.

Some embodiments provide a fin-shaped multi-band antenna module which is suitable in particular for vehicles, with an antenna printed circuit board and a plate disposed thereon. The plate can serve here as a type of carrier structure and can be disposed in particular vertically or perpendicularly on the antenna printed circuit board. The two largest areas of the plate extend in each case in a vertical and in a horizontal direction. In the vertical direction, the plate has a lower area on a lower end and an upper area on an upper end. In the lower area of the plate, the plate is mechanically connected to the antenna printed circuit board. A first monopole extends in the shape of a first arm essentially in the vertical direction on at least one of the largest areas of the plate. In the vertical direction in a lower area of the first monopole, the first monopole is connected via a feed point to the antenna printed circuit board. The first monopole disposed in this way is designed for transmission and reception of electromagnetic waves in an upper telephony frequency range, in particular in a range from 1710 Megahertz to 2170 Megahertz. Telephony applications include, in particular, GSM (Global System for Mobile Communications) and UMTS (Universal Mobile Telecommunications System). The first monopole has an inductive extension coupled with the first monopole in the vertical direction in an upper area. This extension is intended to enable a transmission and reception of electromagnetic waves in a lower telephony frequency range and in a lower LTE frequency range, in particular in a range from 792 Megahertz to 960 Megahertz.

A multi-band antenna module of this type offers the advantage that both the telephony frequency range and the lower LTE frequency range can be served with modest volume requirements.

Embodiments in which the inductive extension of the first monopole comprises a spiral may provide an advantage in terms of the required volume.

The fin-shaped multi-band antenna module may comprise an additional second monopole in the shape of a second arm. This second monopole extends essentially in the vertical direction on at least one of the two largest areas of the plate. In the vertical direction in a lower area of the second monopole, the second monopole is preferably connected via the same feed point as the first monopole to the antenna printed circuit board. The second monopole may, in particular, run in the horizontal direction offset in relation to the first monopole and is preferably designed for transmission and reception of electromagnetic waves in an upper LTE frequency range, in particular in a range from 2.5 Gigahertz to 2.69 Gigahertz.

An antenna module of this type offers the advantage that the upper LTE frequencies can also be served while maintaining the strict volume limitation. In addition, a simpler manufacture is enabled, since the same feed point is used for the second monopole as for the first monopole. In addition, space can be saved and the same transceiver can be used for all telephony services, including LTE-based services.

In one embodiment, the fin-shaped multi-band antenna module has a dipole running essentially in the vertical direction. Said dipole is disposed in the upper area of the plate in such a way that it is capacitively coupled with the first monopole and is thus electromagnetically excitable via the first monopole. The dipole is preferably designed for a transmission and reception of electromagnetic waves in the range of car-to-car frequencies, in particular in the range from 5.875 Gigahertz to 5.925 Gigahertz.

Due to the additional dipole disposed on the plate, it becomes possible to meet the directivity pattern requirements for car-to-car applications, so that car-to-car applications can be supported. Due to the electromagnetic excitation of the dipole via the first monopole, no additional plate and no additional feed point are required, as a result of which a simple manufacture remains guaranteed and substantial costs can be saved. Its disposition in the upper area of the plate results in an advantageous radiation behavior, which is important in particular for car-to-car applications, since the shadowing due to the roof curvature at 5.9 GHz can be eliminated or significantly minimized and very good gain values are achieved in the front and rear areas of the vehicle.

The dipole can be disposed on a first of the two largest areas of the plate and the second monopole can be disposed on a second of the two largest areas of the plate. With a design of this type, this means that the dipole and the second monopole are located on different sides of the plate.

Alternatively, the dipole and the second monopole can be located on a first of the two largest areas of the plate or on a second of the two largest areas of the plate. The dipole and the second monopole can thus be disposed on the same side of the plate.

The antenna module may comprise a stub. This is preferably disposed in a lower area of the first monopole in order to match an impedance of an antenna ensemble comprising or consisting of the first and the second monopole and the dipole to an impedance of a transceiver unit used in the antenna module.

As a result of this impedance matching by means of a stub, as little energy as possible is reflected at the feed point.

The first monopole may have different designs. For example, it may have a bend in the vertical direction in a central area and/or a further extension in the upper area of the plate.

The plate may also have different shapes. For example, the upper area of the plate may have a larger extension in the horizontal direction than the lower area of the plate. In one embodiment, the plate initially has a flat cuboid, viewed from top to bottom in the vertical direction, which bends off to one side roughly level with the bend of the first monopole in order to extend upward in a funnel shape roughly in a central area and then taper trapezoidally. This produces a type of triangular extension of the plate in the horizontal direction in the upper area of the plate.

Such a specific design of the plate offers the possibility of achieving a lower-loss implementation of the multi-band and multi-functional antenna.

In addition, some embodiments provide a vehicle with an antenna module as disclosed herein.

The antenna module may be disposed on the vehicle in such a way that the radiation of the dipole can propagate over a roof of the vehicle (preferably as unrestricted as possible).

The antenna module can be disposed on the vehicle in such a way that the dipole and the second monopole are located behind the first monopole in a direction of travel of the vehicle.

An advantageous radiation behavior may be achieved through this disposition. In particular, very good gain values can be achieved in both the front and rear areas of the vehicle.

FIG. 1 shows a schematic representation of an example embodiment of a fin-shaped multi-band antenna module 1. An antenna printed circuit board 3 and a plate or carrier structure 4 disposed vertically thereon are located in a fin-shaped housing 2 indicated by a dotted line. The two largest areas 4*a*, 4*b* of the plate 4 (i.e. the sides of the plate) extend in a vertical and in a horizontal direction, indicated by arrows and denoted by the reference numbers 5 and 6. In the vertical direction 5, the plate 4 has a lower area 7 on a lower end and an upper area 8 on an upper end. The plate 4 is mechanically connected in its lower area 7 to the antenna printed circuit board 3.

A first monopole 9 in the shape of a first arm extends on both sides 4*a*, 4*b* of the plate 4 essentially in the vertical direction 5. The two parts of the first monopole 9, which run in each case on one of the two sides 4*a*, 4*b* of the plate 4, are interconnected by means of contacts 10*a* to 10*g*. The first monopole has a bend 11 in the vertical direction in a central area and the first monopole is connected in a lower area via a feed point 12 to the antenna printed circuit board 3. The part of the first monopole 9 described thus far is designed for transmission and reception of electromagnetic waves in an upper telephony frequency range from 1710 Megahertz to 2170 Megahertz.

In the vertical direction 5 in an upper area of the first monopole 9, the latter additionally has an inductive extension 13 of the first monopole. This inductive extension 13 is designed here as a spiral in order to achieve the necessary length while maintaining the strict volume requirements. A transmission and reception of electromagnetic waves in a lower telephony frequency range and a lower LTE frequency range from 792 Megahertz to 960 Megahertz are enabled by the inductive extension 13.

The embodiment shown in FIG. 1 has an additional second monopole 17 in the shape of a second arm. The second monopole 17 extends essentially in the vertical direction 5 on one side 4*b* of the plate 4. In the vertical direction in a lower area of the second monopole 17, the second monopole is connected via the feed point 12 to the antenna printed circuit board 3. The second monopole 17 is disposed in the horizontal direction 6 offset in relation to the first monopole 9. The second monopole 17 shown is designed here for a transmission and reception of electromagnetic waves in an upper LTE frequency range from 2.5 Gigahertz to 2.69 Gigahertz.

Figure 2:
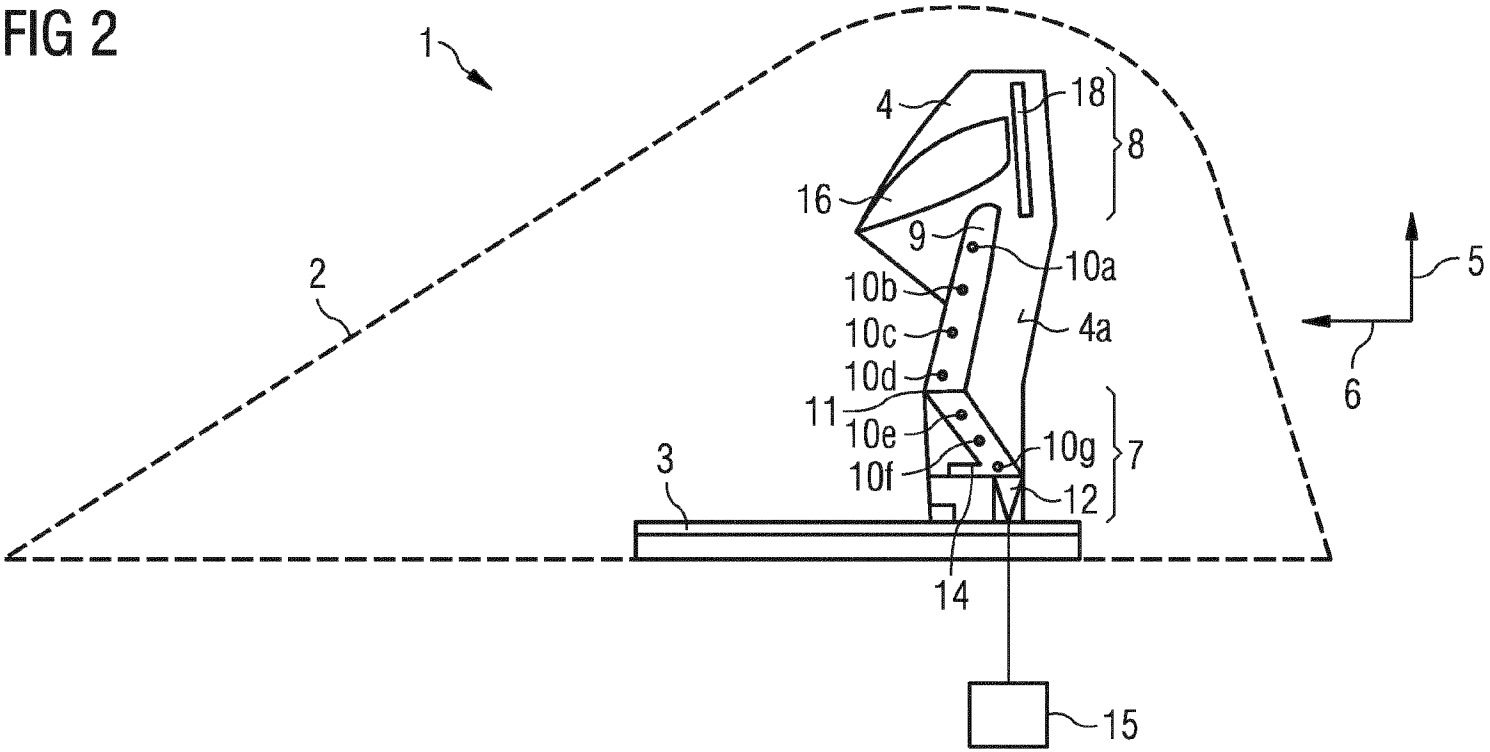
FIG. 2 shows the embodiment from FIG. 1 from the opposite side.

FIG. 2 shows the embodiment illustrated in FIG. 1 schematically from the opposite side. The fin-shaped housing 2, the antenna printed circuit board 3 and the plate 4 are again shown. The vertical direction 5 and the horizontal direction 6 are indicated by arrows. The through-contacts 10*a* to 10*g*, which interconnect the two parts of the first monopole 9, are also shown in FIG. 2. As is evident from FIG. 2, the first monopole 9 has a stub 14 in the vertical direction in a lower area of the first monopole. Said stub serves to match the impedance of the antenna ensemble to an impedance of a transceiver unit 15 using the antenna module.

As FIG. 2 illustrates, the first monopole 9 has a further extension 16 which is disposed on the side 4*a* of the plate 4 on which the second monopole 17 is not located. This further extension 16 improves, in particular, the behavior of the first monopole in various respects.

In addition, the embodiment shown also has a dipole 18 which is located on the side 4*a* of the plate 4 on which the second monopole 17 is not disposed. This dipole 18 runs essentially in the vertical direction 5 in the upper area 8 of the plate 4. The dipole 18 is disposed here in such a way that it is capacitively coupled with the first monopole 9, 16 and can thus be electromagnetically excited via the first monopole 9, 16. The dipole 18 is designed for a transmission and reception of electromagnetic waves in the range of car-to-car frequencies from 5.875 Gigahertz to 5.925 Gigahertz. Due to the disposition of the dipole 18 in the upper area of the plate, said dipole can radiate over the roof of a vehicle.

In the embodiment shown, the second monopole 17 and the dipole 18 are located on different sides 4*a*, 4*b* of the plate 4. This is not essential. Alternatively, an embodiment would be conceivable in which the dipole and the second monopole are located on the same side (4*a* or 4*b*) of the plate 4.

Figure 3:
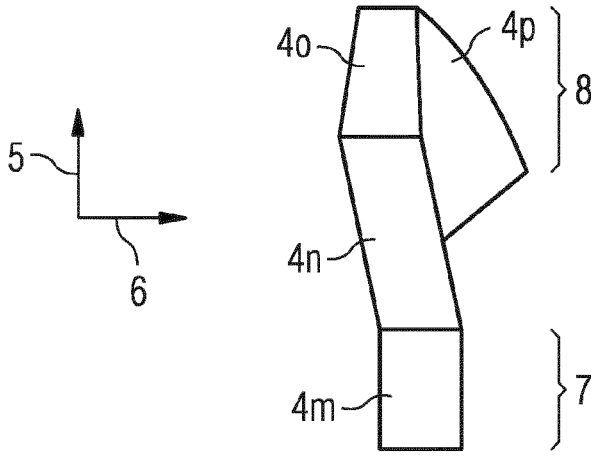
FIG. 3 shows the plate of the embodiment shown in FIG. 1 in a schematic representation.

The plate 4 shown in FIG. 1 has a specific geometry which is shown again in more detail in FIG. 3. In the lower area 7, the plate 4 initially has an essentially cuboid shape 4*m*. An essentially parallelogram-shaped piece 4*n* follows in the vertical direction 5, and is followed in the vertical direction 5 in the upper area 8 of the plate 4 by an essentially cuboid piece 4*o*, wherein a rectangular plate piece 4*p* follows in the horizontal direction 6 on an upper half of the parallelogram-shaped piece 4*n* and the essentially cuboid piece 4*o* in the upper area 8 of the plate 4.

Figure 4:
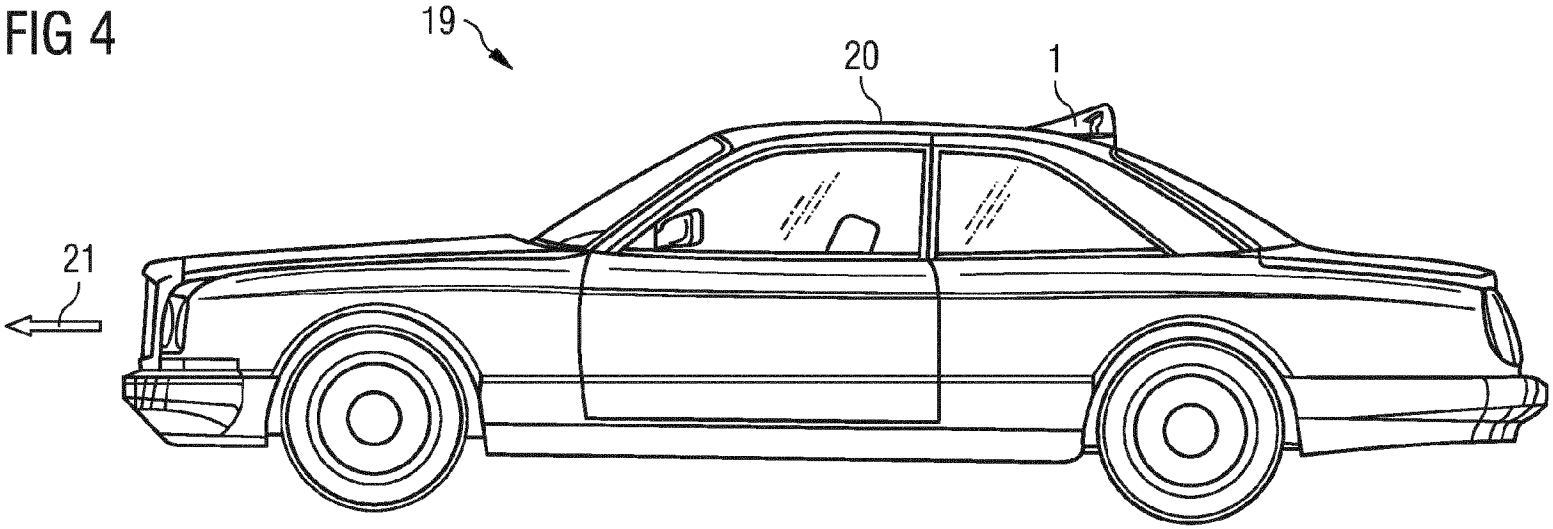
FIG. 4 shows a vehicle including an embodiment of the antenna module.

FIG. 4 illustrates a vehicle 19 with an embodiment 1 of a fin-shaped multi-band antenna module. The antenna module 1 is disposed here on the vehicle 19 in such a way that a radiation of the dipole 18 can propagate over the roof 20 of the vehicle 19. In the example disposition shown in FIG. 4, the antenna module 1 is attached to the vehicle 19 in such a way that the dipole 18 and the second monopole 17 are located behind the first monopole 9 in a direction of travel 21 of the vehicle.

Embodiments of the described invention can have a multiplicity of advantages. In particular, the required homogeneity and the required shape of the directivity pattern in the azimuth can be achieved for all services and, in particular, for car-to-car applications. A forward blocking in car-to-car applications due to the roof curvature is largely avoided. Other antennas in the fin-shaped antenna are prevented from constituting additional obstacles at 6 Gigahertz due to the structure of the antenna module. With the described antenna module, the frequencies for wireless LAN according to IEEE 802.11a can also be covered. The required bandwidths, the required shape of the directivity pattern and the required antenna gain can be achieved while maintaining the currently existing volume of the roof fins. In addition, significant costs can be saved, not least because all services can be provided via a single feed point.

The details described with reference to the figures are to be understood as purely illustrative and non-restrictive. Many modifications can be made to the embodiment described with reference to the figures without departing from the protective scope of the invention as defined in the claims.

REFERENCE NUMBER LIST

1 Embodiment of a fin-shaped multi-band antenna module
2 Fin-shaped housing
3 Antenna printed circuit board

4 Plate
4*a* First of the two largest areas of the plate
4*b* Second of the two largest areas of the plate
4*m* Essentially cuboid piece
4*n* Essentially parallelogram-shaped piece
4*o* Essentially cuboid piece
4*p* Rectangular plate piece
5 Vertical direction
6 Horizontal direction
7 Lower area of the plate
8 Upper area of the plate
9 First monopole
10*a*-10*g* Through-contacts
11 Bend of the first monopole
12 Feed point
13 Inductive extension
14 Stub
15 Transceiver unit
16 Further extension of the first monopole
17 Second monopole
18 Dipole
19 Vehicle
20 Roof of the vehicle
21 Direction of travel of the vehicle

What is claimed is:

1. A fin-shaped multi-band antenna module for a vehicle, the antenna module comprising:

an antenna printed circuit board, a plate connected to the antenna printed circuit board, the plate defining a plane and having a pair of major areas, each extending in both a vertical direction and a horizontal direction, wherein, in the vertical direction, the plate has a lower area at a lower end of the plate and an upper area at an upper end of the plate, and wherein the lower area of the plate is mechanically connected to the antenna printed circuit board and the upper end of the plate extends away from the antenna printed circuit board, a first monopole having a shape of a first arm with a first end and a second end, wherein the first monopole extends substantially vertically on at least one of the two major areas of the plate along the plane, and wherein the first end of the first monopole is connected via a feed point to the antenna printed circuit board and the second end of the first monopole extends toward the upper end of the plate, wherein the first monopole is configured to transmit and receive electromagnetic waves in an upper telephony frequency range between 1710 MHz and 2170 MHz, and wherein the first monopole comprises an inductive extension from the second end of the first monopole disposed on the upper area of the plate, the inductive extension comprising a spiral in the plane of the plate, to enable transmission from the antenna printed circuit board through the first monopole and reception from the inductive extension through the first monopole to the antenna printed circuit board of electromagnetic waves in a lower telephony frequency range and a lower LTE frequency range between 792 MHz and 960 MHz.

2. The antenna module of claim 1, comprising an additional second monopole having a shape of a second arm, wherein the second monopole extends substantially vertically on at least one of the two major areas of the plate and, wherein a lower area of the second monopole is connected via the feed point to the antenna printed circuit board without passing through the first monopole, and wherein the second monopole is offset from the first monopole in the horizontal direction and is configured for transmission and reception of electromagnetic waves in an upper LTE frequency range between 2.5 GHz and 2.69 GHz.

3. The antenna module of claim 2, comprising a dipole extending substantially vertically, wherein the dipole is disposed on the upper area of the plate such that the dipole is capacitively coupled with the first monopole and is electromagnetically excitable via the first monopole, and wherein the dipole is configured for transmission and reception of electromagnetic waves in the range of car-to-car frequencies between 5.875 GHz and 5.925 GHz.

4. The antenna module of claim 3, wherein the dipole is disposed on a first one of the two major areas of the plate and the second monopole is disposed on a second one of the two major areas of the plate.

5. The antenna module of claim 3, wherein the dipole and the second monopole are disposed on the same one of the two major areas of the plate.

6. The antenna module of claim 3, comprising a stub disposed on a lower area of the first monopole and configured to match an impedance of an antenna ensemble including the first and second monopoles and the dipole to an impedance of a transceiver unit using the antenna module.

7. The antenna module of claim 1, wherein the first monopole has a bend in the vertical direction in a central area.

8. The antenna module of claim 1, comprising a further extension of the first monopole which is disposed on the upper area of the plate.

9. The antenna module of claim 1, wherein the upper area of the plate extends further in the horizontal direction than the lower area of the plate.

10. A vehicle comprising:

an antenna module comprising:

an antenna printed circuit board, a plate connected to the antenna printed circuit board, the plate defining a plane and having a pair of major areas, each extending in both a vertical direction and a horizontal direction, wherein, in the vertical direction, the plate has a lower area at a lower end of the plate and an upper area at an upper end of the plate, and wherein the lower area of the plate is mechanically connected to the antenna printed circuit board and the upper end of the plate extends away from the antenna printed circuit board, a first monopole having a shape of a first arm with a first end and a second end, wherein the first monopole extends substantially vertically on at least one of the two major areas and in the plane of the plate, and wherein the first end of the first monopole is connected via a feed point to the antenna printed circuit board and the second end of the first monopole extends toward the upper end of the plate, wherein the first monopole is configured to transmit and receive electromagnetic waves in an upper telephony frequency range between 1710 MHz and 2170 MHz, and wherein the first monopole comprises an inductive extension from the second end of the first monopole disposed on the upper area of the plate, the inductive extension comprising a spiral in the plane of the plate, to enable transmission from the antenna printed circuit board through the first monopole and reception from the inductive extension through the first monopole to the antenna printed circuit board of electromagnetic waves in a lower telephony frequency range and a lower LTE frequency range between 792 MHz and 960 MHz.

11. The vehicle of claim 10, wherein the antenna module is disposed on the vehicle such that the dipole and the second monopole are located behind the first monopole along in a direction of travel of the vehicle.

12. The vehicle of claim 10, wherein the antenna module comprises an additional second monopole having a shape of a second arm, wherein the second monopole extends substantially vertically on at least one of the two major areas of the plate and, wherein a lower area of the second monopole is connected via the feed point to the antenna printed circuit board without passing through the first monopole, and wherein the second monopole is offset from the first monopole in the horizontal direction and is configured for transmission and reception of electromagnetic waves in an upper LTE frequency range between 2.5 GHz and 2.69 GHz.

13. The vehicle of claim 12, wherein the antenna module comprises a dipole extending substantially vertically, wherein the dipole is disposed on the upper area of the plate such that the dipole is capacitively coupled with the first monopole and is electromagnetically excitable via the first monopole, and wherein the dipole is configured for transmission and reception of electromagnetic waves in the range of car-to-car frequencies between 5.875 GHz and 5.925 GHz.

14. The vehicle of claim 13, wherein the dipole of the antenna module is disposed on a first one of the two major areas of the plate and the second monopole of the antenna module is disposed on a second one of the two major areas of the plate.

15. The vehicle of claim 13, wherein the dipole and the second monopole of the antenna module are disposed on the same one of the two major areas of the plate.

16. The vehicle of claim 13, wherein the antenna module comprises a stub disposed on a lower area of the first monopole and configured to match an impedance of an antenna ensemble including the first and second monopoles and the dipole to an impedance of a transceiver unit using the antenna module.

17. The vehicle of claim 10, wherein the first monopole of the antenna module has a bend in the vertical direction in a central area.

18. The vehicle of claim 10, wherein the antenna module comprises a further extension of the first monopole which is disposed on the upper area of the plate.

* * * * *